US007823431B2

(12) United States Patent
Shore et al.

(10) Patent No.: US 7,823,431 B2
(45) Date of Patent: Nov. 2, 2010

(54) METHOD AND APPARATUS FOR TEMPORARILY INTERRUPTING THE PASSAGE OF LONG PRODUCTS BETWEEN UPSTREAM AND DOWNSTREAM PATHS IN A ROLLING MILL

(75) Inventors: T. Michael Shore, Princeton, MA (US); Melicher Puchovsky, Dudley, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 1250 days.

(21) Appl. No.: 10/861,245

(22) Filed: Jun. 4, 2004

(65) Prior Publication Data

US 2005/0258293 A1 Nov. 24, 2005

Related U.S. Application Data

(60) Provisional application No. 60/478,520, filed on Jun. 13, 2003.

(51) Int. Cl.
*B21B 41/00* (2006.01)
*B21C 47/00* (2006.01)

(52) U.S. Cl. ..... 72/146; 72/148; 72/228; 242/361.3; 242/403

(58) Field of Classification Search ..... 72/146, 72/148, 200, 202, 227, 228, 231, 250; 29/527.7; 242/403, 361.3
See application file for complete search history.

(56) References Cited

U.S. PATENT DOCUMENTS 2,658,741 A 11/1953 Schmidt et al.
4,019,359 A * 4/1977 Smith ..... 72/231
4,528,834 A * 7/1985 Aoyagi et al. ..... 72/202
4,630,352 A 12/1986 Ginzburg et al.
4,691,874 A * 9/1987 Inamori et al. ..... 242/362.1
4,698,897 A * 10/1987 Frommann et al. ..... 29/527.7
5,131,134 A 7/1992 Quambusch et al.
5,335,713 A * 8/1994 Hoppmann et al. ..... 164/441
5,494,264 A 2/1996 Wolff et al.
5,735,477 A 4/1998 Shore et al.
5,778,716 A 7/1998 Moser
6,502,445 B1 * 1/2003 Drigani et al. ..... 72/148
6,604,398 B1 * 8/2003 Hansen ..... 72/206

FOREIGN PATENT DOCUMENTS

DE 40 13 582 C1 4/1990
EP 0 647 485 A1 9/1994

(Continued)

OTHER PUBLICATIONS

"Making Work Faster, Safer, and Easier with Lifting, Positioning, and Transporting Products," Southworth Corporation, Portland Maine. Nov. 2007.

*Primary Examiner*—Dmitry Suhol
(74) *Attorney, Agent, or Firm*—Michael J. Wallace, Jr.

(57) ABSTRACT

A method and apparatus is disclosed for temporarily interrupting the passage of a long product between upstream and downstream paths in a rolling mill. Product passing along the upstream path is delivered onto a cylindrical drum. The drum is rotated in one direction to accumulate the product thereon in a series of windings. The direction of drum rotation is then reversed to unwind and deliver the accumulated product to the downstream path.

7 Claims, 6 Drawing Sheets

FOREIGN PATENT DOCUMENTS

| | | |
|---|---|---|
| FR | 1.368.354 | 6/1963 |
| JP | 05-177214 | 7/1993 |
| JP | 08-103820 | 4/1996 |
| JP | 2000-289938 | 10/2000 |
| WO | WO 96/32509 | 10/1996 |
| WO | WO 00/59650 | 10/2000 |

* cited by examiner

FIG. 5

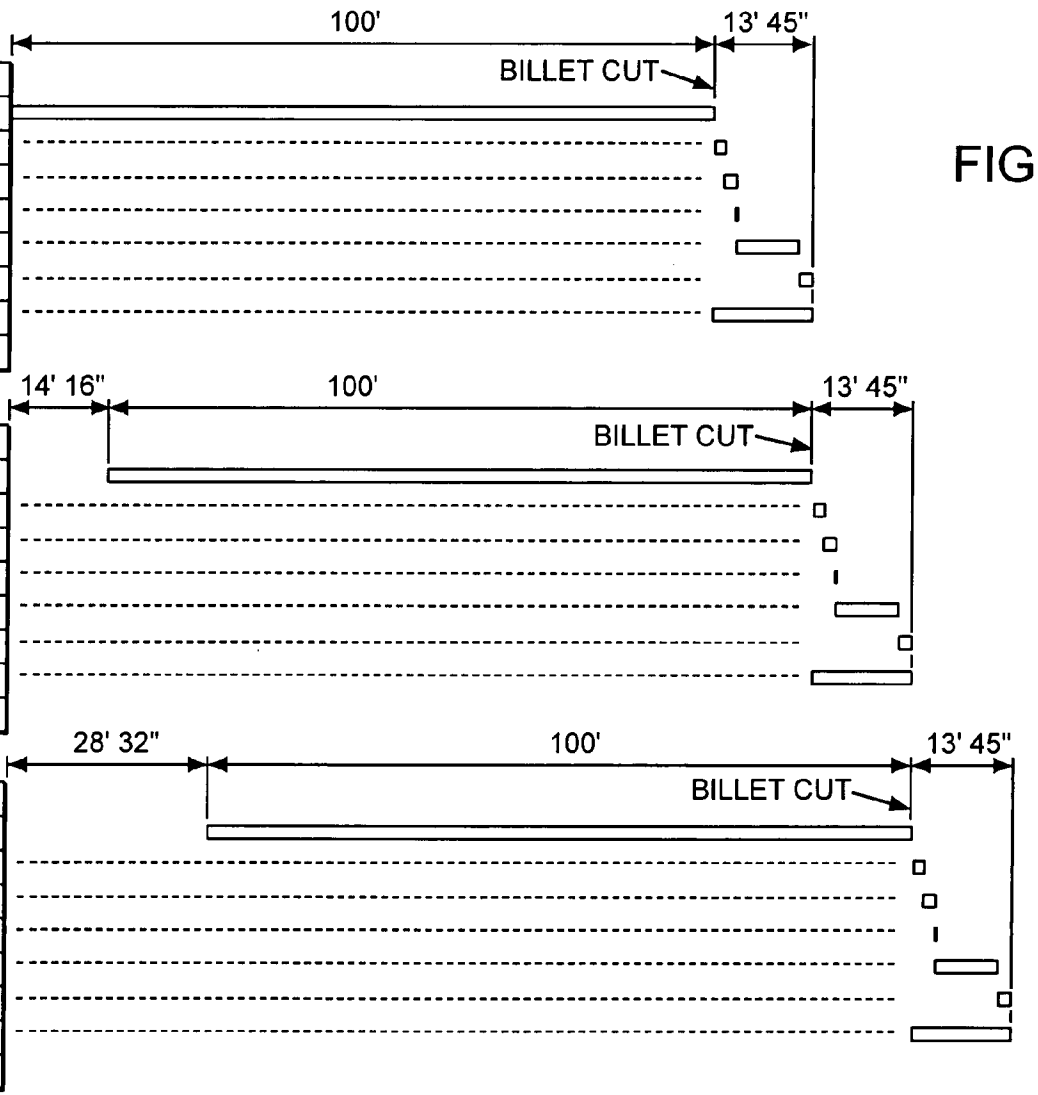

| SYSTEM 10A | TIMES |
|---|---|
| 1. CASTING | 100' |
| 2. CLEAR TROUGHS 22 | 1' 15" |
| 3. REORIENTATION | 1' 40" |
| 4. MILL THREAD TIME | 0' 25" |
| 5. ROLLING TIME | 8' 45" |
| 6. RETURN | 1' 40" |
| TOTAL (2)-(6) | 13' 45" |
| NEW BAR TO COIL BOX | 14' 16" |

| SYSTEM 10B | TIMES |
|---|---|
| 1. CASTING | 100' |
| 2. CLEAR TROUGHS 22 | 1' 15" |
| 3. REORIENTATION | 1' 40" |
| 4. MILL THREAD TIME | 0' 25" |
| 5. ROLLING TIME | 8' 45" |
| 6. RETURN | 1' 40" |
| TOTAL (2)-(6) | 13' 45" |
| NEW BAR TO COIL BOX | 14' 16" |

| SYSTEM 10C | TIMES |
|---|---|
| 1. CASTING | 100' |
| 2. CLEAR TROUGHS 22 | 1' 15" |
| 3. REORIENTATION | 1' 40" |
| 4. MILL THREAD TIME | 0' 25" |
| 5. ROLLING TIME | 8' 45" |
| 6. RETURN | 1' 40" |
| TOTAL (2)-(6) | 13' 45" |
| NEW BAR TO COIL BOX | 14' 16" |

METHOD AND APPARATUS FOR TEMPORARILY INTERRUPTING THE PASSAGE OF LONG PRODUCTS BETWEEN UPSTREAM AND DOWNSTREAM PATHS IN A ROLLING MILL

CROSS REFERENCE TO RELATED APPLICATIONS

This application claims priority from provisional application Ser. No. 60/478,520 filed Jun. 13, 2003.

BACKGROUND OF THE INVENTION

1. Field of the Invention

This invention relates generally to rolling mills in which billets are continuously hot rolled into long products, and is concerned in particular with a method and apparatus for temporarily interrupting the passage of such products between upstream and downstream paths within the mill.

2. Description of the Prior Art

As herein employed, the term "long products" includes bars, rods and the like, and does not include flat products, examples being slabs and strips.

The present invention may be employed to solve problems existing in both nonferrous and ferrous rolling mill environments. For example, in a nonferrous mill employing "up casting" systems, the cast product is delivered upwardly from the casting wheel. This has the advantage of producing high quality products containing minimum amounts of oxides. However, this advantage is, to some extent, offset by slow delivery speeds on the order of 3-10 feet/minute. Problems relating to product heat loss and fire cracking of work rolls preclude the introduction of such slow moving cast products directly into a rolling mill.

There exists a need, therefore, for a method and apparatus that makes it possible to operate upcasting systems with relatively slow delivery speeds in direct sequence with rolling mills having higher take in speeds.

Different problems are encountered in ferrous rolling mills, where typically, billets are heated to an elevated rolling temperature in a furnace. The heated billets are then subjected to continuous rolling in successive roughing, intermediate and finishing sections of the mill, with each mill section being comprised of multiple roll stands. For larger finished products, the entire mill can usually be operated at or close to the maximum capacity of the furnace. However, when the rolling schedule calls for smaller finished products, e.g., 5.5 mm rounds, the capacity of the finishing section is often reduced to well below that of the furnace and the roughing and intermediate mill sections. Under these circumstances, the roughing and intermediate sections can be slowed to match the capacity of the finishing section, but there are limits beyond which this becomes impractical. This is again because acceptable rolling procedure dictates that the heated billets should be introduced into the first stand of the roughing section at a minimum take in speed below which excessive heat loss and fire cracking of the work rolls can occur.

In other cases, for example when rolling high speed tool steels or nickel based alloys, a higher take in speed is required to avoid excessive cooling of the billet, while lower finishing speeds are required to avoid excessive heat generation, which can cause core melting and surface cracking of the product.

The size of the billet can be reduced in order to accommodate rolling at the maximum delivery speed of the mill and at a safe take in speed. However, this would require a new pass design for the roll stands, different guides, a lowering of the coil weight of the finished product, and a reduced production rate. The necessity to store different size billets would create further problems.

Thus, in ferrous mills there also exists a need for a method and apparatus that will make it possible to roll smaller size products while maintaining the mill take in speeds at or above acceptable minimums, without having to reduce the size of the billets being processed, and preferably while continuing to roll at or close to the mill's maximum tonnage rate.

SUMMARY OF THE INVENTION

In accordance with the present invention, a method and apparatus is provided for temporarily interrupting the passage of long products between upstream and downstream paths in a rolling mill. The products are delivered from the upstream path to a coil box having a cylindrical drum, and the drum is rotated in one direction to accumulate the product in a series of windings. The rotational direction of the drum is then reversed to unwind and deliver the accumulated product to the downstream path.

In the nonferrous mill environment described above, multiple up casting systems are coupled to a single rolling mill. The output of each up casting system is received by a coil box of the present invention at the up casting system's relatively slow casting speed, and is temporarily accumulated before being delivered to the rolling mill at its higher take in speed. Operations of the casting systems are sequentially staggered to provide the rolling mill with a substantially constant supply of cast products.

In the above described ferrous rolling mill environment, products emerging from the intermediate section of the mill are alternately switched to multiple coil boxes of the present invention. Each coil box feeds a separate mill finishing section. Products received at the relatively high delivery speed of the intermediate mill section are temporarily accumulated, alternately, by the multiple coil boxers, before being delivered at slower speeds to their respective finishing sections.

The alternate use of multiple mill finishing sections, each fed by a coil box of the present invention, makes it possible to roll smaller sized products without having to reduce the furnace output or the size of the billets being rolled.

These and other features and advantages of the present invention will now be described in greater detail with reference to the accompanying drawings, wherein:

BRIEF DESCRIPTION OF THE DRAWINGS

FIG. 5 depicts an exemplary timing sequence for the mill layout shown in FIGS. 1-4;

DETAILED DESCRIPTION OF PREFERRED EMBODIMENTS

Figure 1:
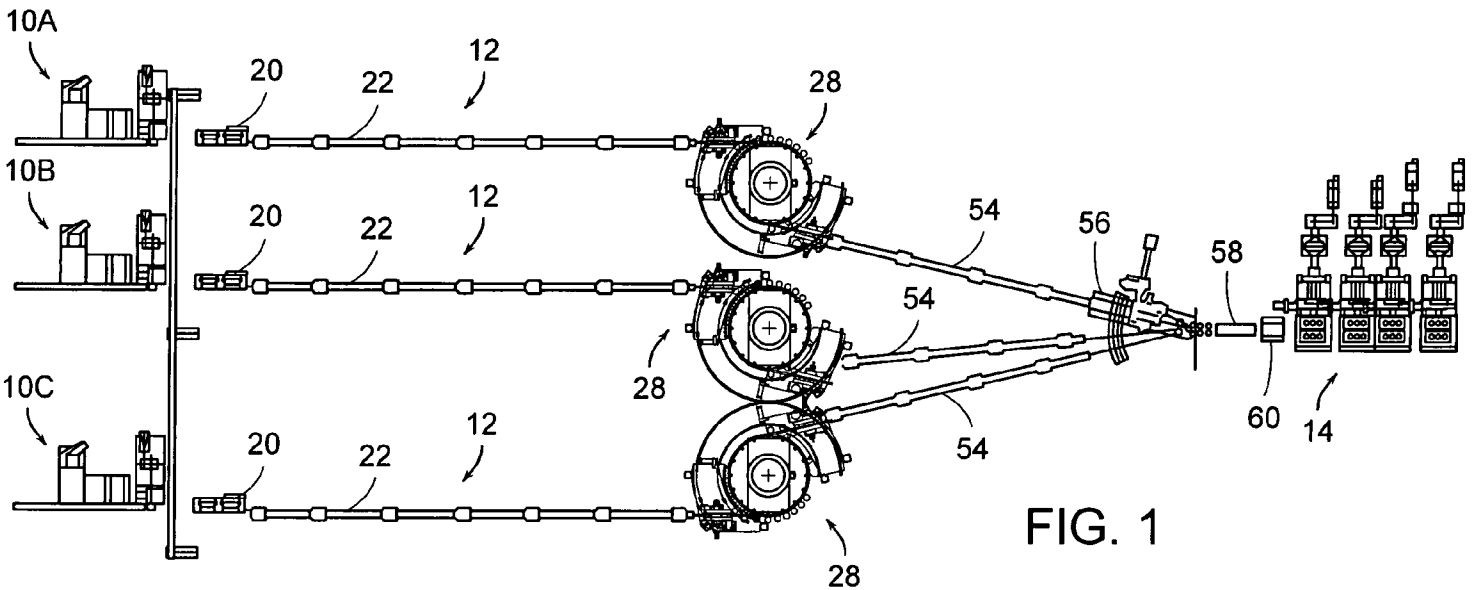
FIG. 1 is a plan view of a nonferrous mill layout embodying coil boxes of the present invention.
Figure 2:
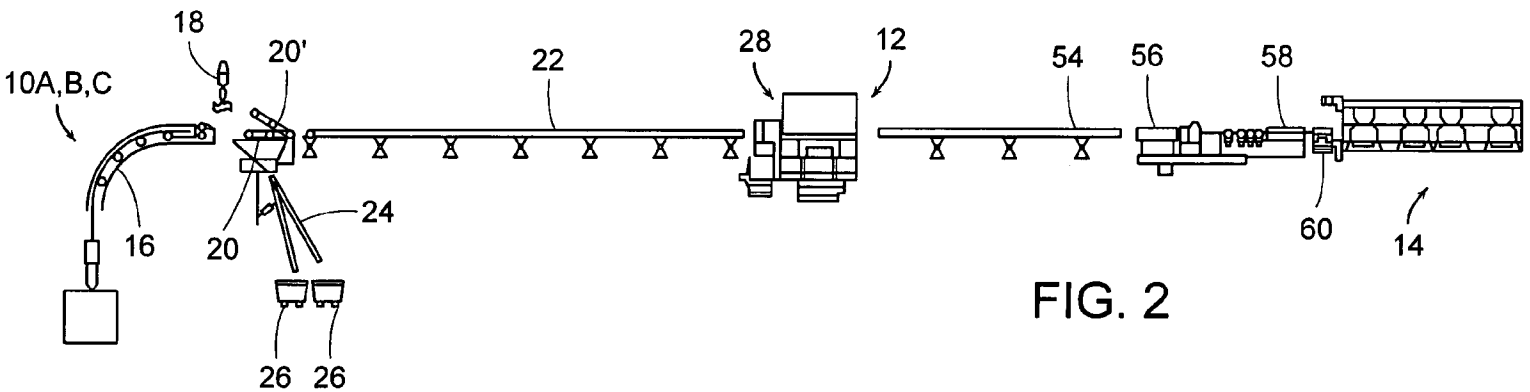
FIG. 2 is a side sectional view of one of the up casting systems and its connection to the rolling mill.

With reference initially to FIGS. 1 and 2, a mill layout includes a plurality of up casting systems 10A, 10B and 10C respectively connected by delivery lines generally indicated at 12 to a common single strand rolling mill 14.

The up casting systems 10A, 10B and 10C may be of any known type, such as that marketed by International Metals & Chemical Group of Jenkintown, Pa. Each up casting system is configured to direct the cast product upwardly along a curved track 16 for delivery past the operative range of a shear 18 to a discharge table 20 at the entry end of a respective delivery line.

As shown in FIG. 2, the discharge table 20 is pivotally adjustable between a horizontal position, as shown by the solid lines, and a raised position 20' shown in dotted. When in its horizontal position, the table is aligned to deliver product to an "upstream" path 22 defined by a series of rollerized troughs. When in its raised position, the discharge table is configured to allow the cast product to pass downwardly via chute 24 to scrap bins 26. The downwardly directed product is cut into scrap lengths by the shear 18.

Figure 3:
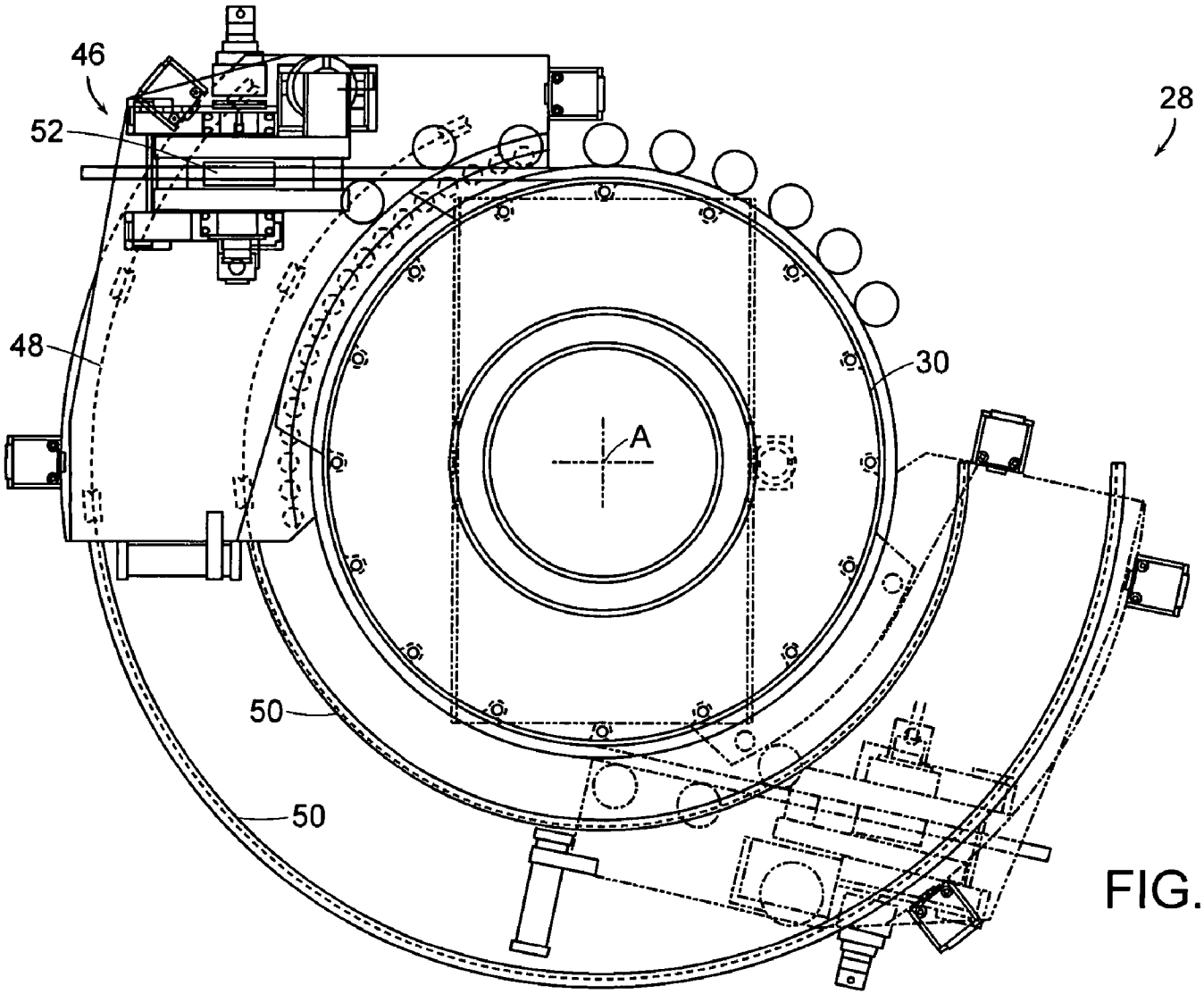
FIG. 3 is an enlarged plan view of one of the coil boxes spooler shown in FIGS. 1 and 2.
Figure 4:
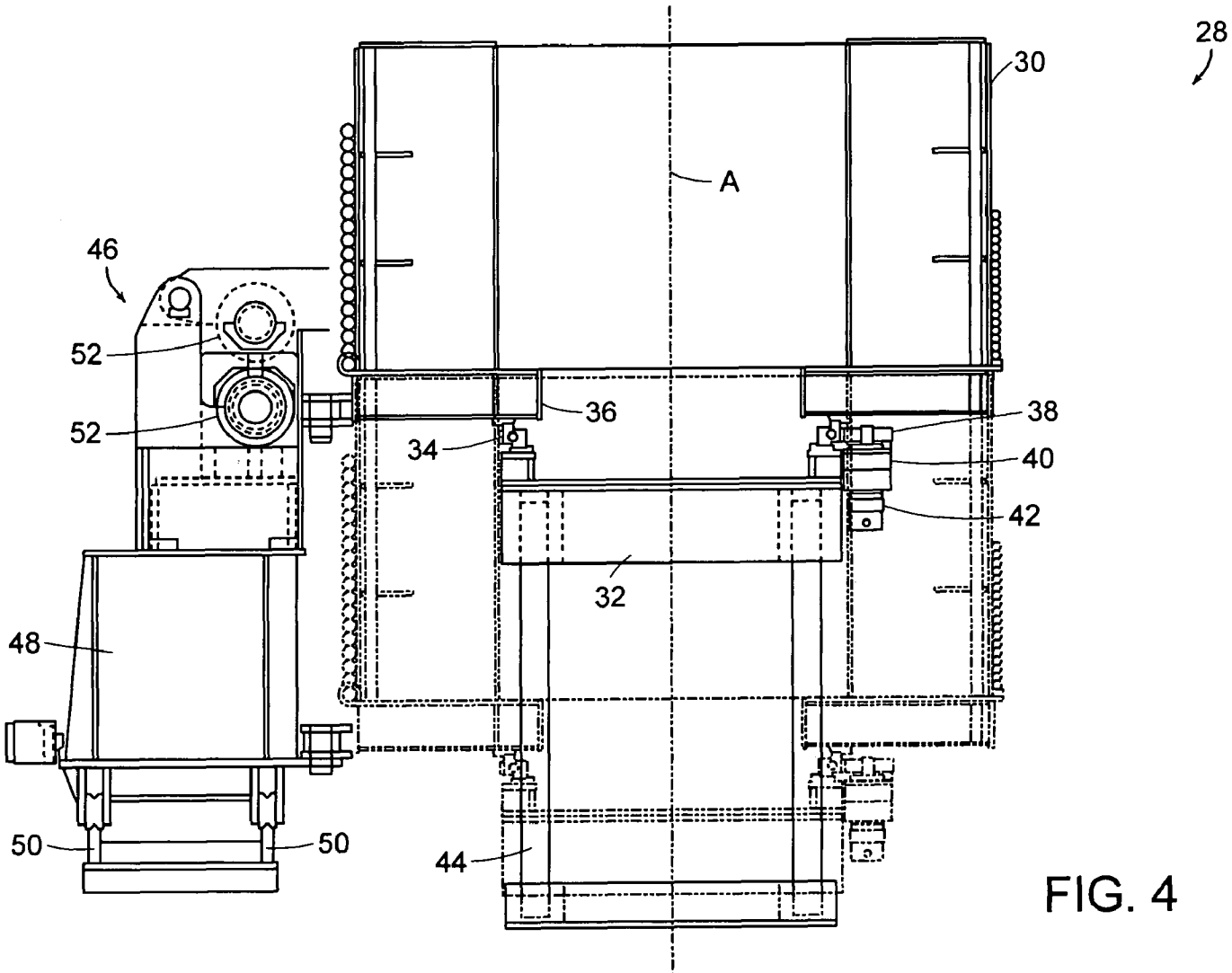
FIG. 4 is a vertical sectional view taken through the coil box shown in FIG. 3.

Each upstream path 22 leads to a coil box 28. As can be seen by further reference to FIGS. 3 and 4, each coil box includes a cylindrical drum 30 mounted on an elevator platform 32 for rotation about a vertical axis A. An externally toothed circular collar 34 on the base 36 of the drum 30 is engaged by a drive pinion 38 on the output shaft of a gear reducer 40, which in turn is driven by a hydraulic motor 42 or the like. Motor 42 may be operated to rotate the drum 30 in either a clockwise and counterclockwise direction.

The elevator platform 32 is vertically adjustable by any known mechanism, such as for example a scissor lift table 44 of the type supplied by Southworth of Falmouth, Me.

Each coil box 28 additionally includes a pinch roll unit 46 mounted on a carriage 48 moveable around the drum axis A on curved guide rails 50. The pinch roll unit 46 has driven pinch rolls 52 configured and arranged to grip and propel the cast product.

A downstream path 54 defined by another series of rollerized troughs leads from each coil box 28 to the operative range of a receiving switch 56. The switch 56 is pivotally adjustable to selectively communicate with and to direct product received from any one of the downstream paths 54 to the rolling mill 14.

Using as an example the operation of one of the up casting systems 10A, 10B or 10C, during start up and until the cast product has stabilized dimensionally, the respective discharge table 20 is elevated to allow scrap pieces subdivided by the shear 18 to be directed downwardly into the bins 26. When acceptable product is achieved, the discharge table is lowered to its horizontal operative position, and the cast product is directed along the upstream path 22 to the coil box 28 for winding on the drum 30. The associated pinch roll unit 46 insures a constant feed of the product to the drum, and the drum is rotated at a peripheral speed matching the delivery speed of the caster while being gradually lowered during the winding process, with the rate of descent being approximately one product diameter per drum revolution.

When one coil weight has passed by the shear 18, the shear is activated to cut the product, and the rotational speed of the drum is accelerated to rapidly pull the remainder of the severed product length out of the upstream path 22. Drum rotation is stopped when the tail end of the severed product length reaches the pinch roll unit 46.

The drum 30 is then rotated in the opposite direction through approximately 180°, with an accompanying travel of the carriage 48 around the guide rails 50 to thereby realign the pinch roll unit 46 with the downstream path 54. The pinch roll unit is then operated in reverse to unwind the product from the drum at a speed matching that of the take in speed of the mill 14, which typically will be about 60 feet per minute. The switch 56 will direct the unwinding product into the first mill stand. The circumferentially spaced locations at which the product is wound onto and discharged from the drum are at a common horizontal level dictated by movement of the carriage 48 along the rails 50.

The troughs defining the upstream and downstream paths 22, 54 and the drums 30 may be heated, and an additional induction heater 58 and descaler 60 may be located between the switch 56 and the first roll stand of the mill 14.

FIG. 5 depicts an exemplary timing sequence for the sequential staggered operation of the mill layout shown in FIGS. 1-4. Assume that each casting system 10A, 10B, 10C produces 10,000 lb of cast product having a 2.5" diameter and a length of 529 feet during a 100 minute casting time. Assume further that the up casters have casting speeds of 5-8 feet/min., and that the take in speed of the rolling mill is 60 feet/min.

After the shear 18 cuts the product, one minute and fifteen seconds is required to clear the severed product from the upstream paths 22. Another one minute and forty seconds is consumed by reorientation of the drum 30 and carriage 48 to bring the pinch roll unit 46 into alignment with the downstream path 54. Threading of the product into the mill takes twenty five seconds, and rolling of the coiled product takes eight minutes and forty five seconds. Another one minute and forty seconds is required to return the drum and pinch roll unit into position to receive the next product length. Thus, the total time elapsed between the cut of shear 18 and the return of the drum and pinch roll unit to the receiving position is thirteen minutes and forty five seconds. The time required for the lead end of the next product length to reach the pinch roll unit 46 is fourteen minutes and sixteen seconds.

It will be seen, therefore, the by staggering the sequential operation of casting system 10B by fourteen minutes and sixteen seconds, and casting system 10C by twice this time, the rolling mill can be operated substantially continuously at its taking speed of 60 feet per minute, which is substantially higher than the 5-8 feet per minute delivery speed of the casting systems.

Figure 6:
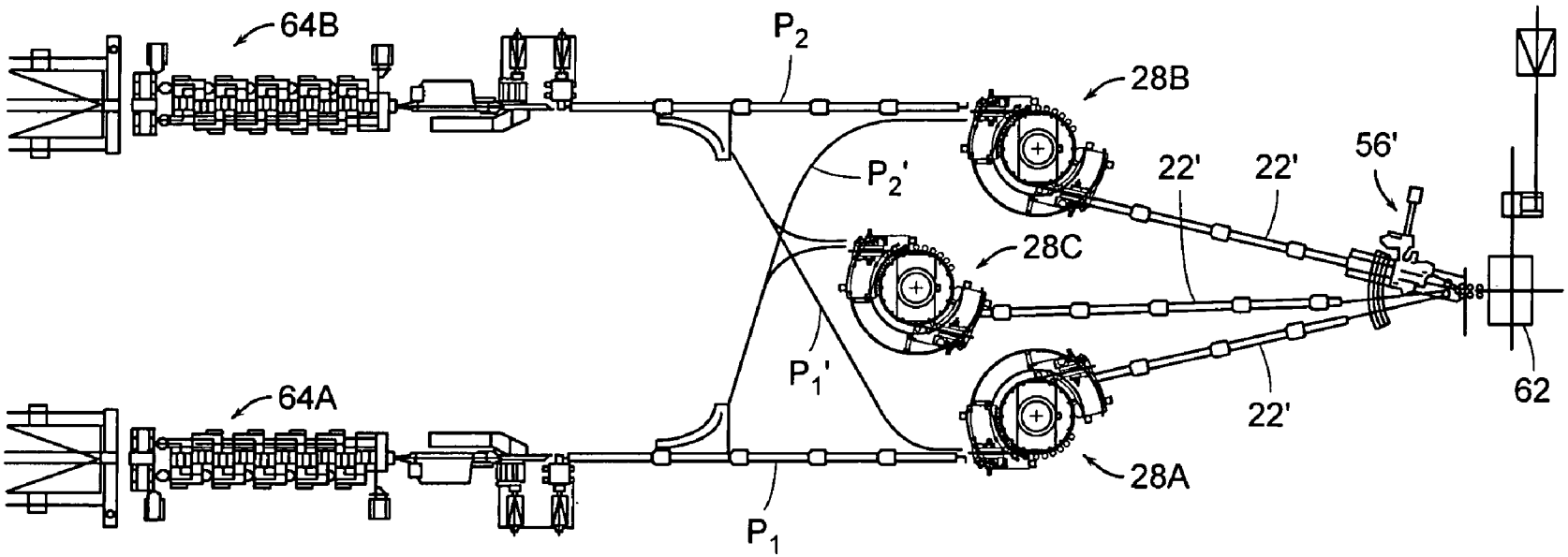
FIG. 6 is a plan view of a ferrous mill embodying the concepts of the present invention.

In an exemplary ferrous rolling mill environment, as depicted in FIG. 6, a switch 56' directs billet lengths of hot rolled product emerging from the last roll stand 62 of the intermediate mill section selectively along upstream paths 22' to three coil boxes 28A, 28B and 28C. Coil box 28A is arranged to direct its output via path $P_1$ to mill finishing section 64A, and alternatively to mill finishing section 64B via path $P_1'$. Similarly, coil box 28B is arranged to direct its output via path $P_2$ to mill finishing section 64B, and alternatively to mill section 64A via path $P_2'$. Coil box 28C is arranged to feed finishing mill section 64A via path $P_2'$, or finishing mill section 64B via path $P_1'$.

Figure 7:
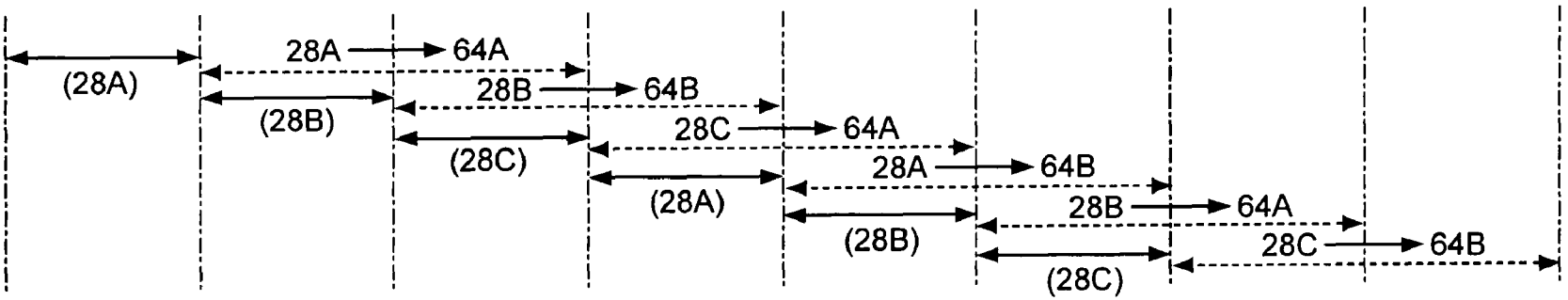
FIG. 7 depicts an exemplary timing sequence for the mill layout shown in FIG. 6.

Typically, when the mill is set up to roll a small diameter product, e.g., 5.5 mm rod, the maximum delivery speed $V_1$ at roll stand 62 will exceed the maximum take in speed $V_2$ at the entry end of one mill finishing section, e.g., section 64A. In order to avoid having to slow the mill down or switch to smaller billets, an additional mill finishing section 64B is employed with three coil boxes 28A, 28B, 28C. Each coil box can receive product from roll stand 62 at velocity $V_1$, and deliver product to a selected one of the mill finishing sections at velocity $V_2$. Assuming that $V_1$ is approximately twice $V_2$, a typical timing sequence would be as shown in FIG. 7, where solid lines indicate time intervals for loading the coil boxes, and broken lines indicate the time intervals required to unload the coil boxes to the mill finishing sections. By appropriately staggering the delivery of billet lengths of product from roll stand 62 to the coil boxes 28A, 28B, 28C, the entire mill, including the two finishing sections, can be operated substantially continuously.

We claim:

1. An apparatus for temporarily interrupting the passage of a long product between upstream and downstream paths, said apparatus comprising:

a cylindrical drum positioned between said paths, said drum being rotatable about a stationary vertical axis;

means for rotating said drum in one direction about said axis to receive a product from said upstream path and to accumulate said product thereon in a series of windings, and for reversing the direction of rotation of said drum about said axis to unwind the accumulated product therefrom to said downstream path, said product being received on and unwound from said drum at a common horizontal level; and means for vertically displacing said drum along said axis and during drum rotation to vertically distribute said windings on said drum.

2. The apparatus of claim 1 further comprising delivery means operable at spaced locations around the circumference of said drum for delivering product from said upstream path to said drum and for delivering product unwinding from said drum to said downstream path.

3. The apparatus of claim 2 wherein said delivery means serves to forcibly propel said product.

4. The apparatus of claim 2 or 3 wherein said delivery means comprises a single driven pinch roll unit, and means for moving said pinch roll unit around the circumference of said drum between said locations.

5. The apparatus of claim 4 wherein said pinch roll unit is driven in one direction to deliver said product to said drum, and is driven in the opposite direction to deliver the product unwinding from said drum to said downstream path.

6. An apparatus for temporarily interrupting the passage of a long product between upstream and downstream paths, said apparatus comprising:

a cylindrical drum positioned between said paths, said drum being rotatable about a stationary vertical axis;

delivery means operable at a first location around the circumference of said drum for delivering said product from said upstream path to said drum;

means for rotating said drum about said axis in one direction to accumulate said product thereon in a series of windings, and for reversing the direction of rotation of said drum about said axis to unwind the accumulated product therefrom;

said delivery means being operable at a second location around the circumference of said drum for delivering the product unwinding from said drum to said downstream path, said delivery means comprising a single pinch roll unit movable in a horizontal plane between said first and second locations, said pinch roll unit being driven in a first direction at said first location and in an opposite second direction at said second location;

and means for vertically displacing said drum along said axis and during rotation of said drum at a rate of approximately one product diameter per drum revolution.

7. A method of temporarily interrupting the passage of a long product between upstream and downstream paths, said method comprising:

providing a cylindrical drum positioned between said paths, said drum being rotatable about a stationary vertical axis;

rotating said drum in one direction to receive a product from said upstream path while vertically displacing said drum along said axis to thereby accumulate said product thereon in a series of vertically distributed windings; and reversing the direction of rotation of said drum about said axis to unwind the accumulated product therefrom to said downstream path.

* * * * *